US005289809A

United States Patent [19]

Kamiya et al.

[11] Patent Number: 5,289,809

[45] Date of Patent: Mar. 1, 1994

[54] INTERNAL COMBUSTION ENGINE CONTROL APPARATUS

[75] Inventors: Naoyuki Kamiya; Toshifumi Hayami; Tatsuya Oka, all of Kariya, Japan

[73] Assignee: Nippondenso Co., Ltd., Kariya, Japan

[21] Appl. No.: 32,356

[22] Filed: Mar. 16, 1993

[30] Foreign Application Priority Data

Mar. 17, 1992 [JP] Japan ..... 4-060653
Jul. 13, 1992 [JP] Japan ..... 4-185482

[51] Int. Cl.[5] ..... F02D 41/06; F02D 41/18
[52] U.S. Cl. ..... 123/491
[58] Field of Search ..... 123/491, 179.16, 478, 123/480, 494

[56] References Cited

U.S. PATENT DOCUMENTS 4,454,907 1/1986 Mouri et al. ..... 364/431.1
4,564,907 1/1986 Mouri et al. ..... 123/491 X
4,578,996 4/1986 Abe et al. ..... 123/491 X
4,582,036 4/1986 Kiuchi et al. ..... 123/491
4,705,004 11/1987 Takahashi et al. ..... 123/491
4,949,693 8/1990 Sonoda ..... 123/491
5,074,271 12/1991 Suzuki et al. ..... 123/491
5,188,082 2/1993 Udo et al. ..... 123/491
5,215,062 6/1993 Asano et al. ..... 123/491

FOREIGN PATENT DOCUMENTS 57-173537 10/1982 Japan .
57-181938 11/1982 Japan .
63-25356 2/1988 Japan .

*Primary Examiner*—Willis R. Wolfe
*Attorney, Agent, or Firm*—Cushman, Darby & Cushman

[57] ABSTRACT

An internal combustion engine control apparatus is provided which is capable of performing various controls based upon the air quantity immediately after a current heated element of a hot wire air flow meter is heated to a predetermined temperature. When a key switch is rotated to an "ON" position, a large current flows through the air flow meter and the detected intake air quantity greatly exceeds the actual intake air quantity and therefore during the warm up period of the heater, the fuel injection amount is a constant corresponding to the coolant temperature until the engine speed reaches 500 rpm. Likewise during this warm up period, the smoothing processing of the fuel injection quantity is stopped. The fuel injection amount is switched from the constant value during starting to a variable quantity corresponding to air flow quantity when the output value of the air flow meter is less than a predetermined value and the engine speed is greater than 500 rpm or a predetermined time has elapsed since the key switch has been "ON".

9 Claims, 15 Drawing Sheets

INTERNAL COMBUSTION ENGINE CONTROL APPARATUS

BACKGROUND OF THE INVENTION

The present invention relates to an internal combustion engine control apparatus and in particular to an internal combustion engine control apparatus for controlling the internal combustion engine based upon the output of a hot wire air flow meter.

Internal combustion engine control apparatus which detect an intake air quantity fed to the engine for calculating various engine controlled quantities based upon the detected intake air quantity have heretofore been known. Many of such internal combustion engine control apparatus use a hot wire air flow meter for detecting the intake air quantity. This type of air flow meter has a current heating element in an air intake passage. A current conducting through the element is controlled so that the element is heated to a predetermined temperature or so that it provides a predetermined quantity of heat. Since the heat radiated from the current heating element corresponds to the intake air quantity, the intake air quantity can be detected from the conducting current or the temperature of the heating element. This type of air flow meter has advantages in that it has a fast response, a wide dynamic range and a high precision and is compact in size and economical.

However, a large current is conducted through such a hot wire air flow meter until the current heated element is heated to a predetermined temperature (for example, the temperature of the intake air plus 200° C.)(this will be referred to as "activated or activation"). Accordingly, the intake air quantity detected by the hot wire air flow meter becomes remarkably higher than the actual value. If the engine is started by the activation of the hot wire air flow meter, accurate control can not be made. For example, if the fuel quantity is controlled by directly using the detection result, the air/fuel ratio becomes a remarkably fuel rich ratio.

Therefore, a method of controlling the fuel injection quantity of a predetermined value until a predetermined period of time which is longer than the period of time taken to activate the hot wire air flow meter after turning on of a key switch is proposed in Japanese Unexamined Patent Publication Sho 57-173537 and a method of controlling the fuel injection quantity based upon control factors such as coolant temperature other than intake air quantity is proposed in U.S. Pat. No. 4,564,907.

In these internal engine control apparatus, so-called smoothing processing in which previously executed controlled quantities and newly calculated controlled quantities are averaged at a given factor is performed and the engine is controlled based upon the controlled quantity which is subjected to the smoothing processing. Therefore, control is not immediately made based upon the intake air quantity even after the lapse of the predetermined period of time and the activation of the air flow meter for the reason as follows: The internal combustion engine control apparatus calculates a controlled quantity having an error based on no intake air quantity until the predetermined period of time has lapsed. The controlled quantity after the lapse of the predetermined period of time is influenced by the controlled quantity having an error due to the smoothing processing.

Therefore, the fuel injection quantity may continue to be excessive with respect to the actual intake air quantity for a while even after the activation of the hot wire air flow meter. In this case, the air/fuel ratio is a fuel rich ratio for a while, resulting in that the emission and fuel consumption is worsened.

In the system of the above mentioned U.S. Pat. No. 4,564,907, fuel is supplied at a constant rate corresponding to the engine coolant temperature if the fuel injection quantity can not be operated from the output of the hot wire air flow meter, that is, for a predetermined period of time after turning on of a key switch. Thereafter, the fuel injection quantity is operated from the intake air quantity detected by the hot wire air flow meter and the engine rotation number. Briefly, the period of time which is taken to heat the hot wire of the air flow meter to a predetermined temperature is preliminarily predicted and preset.

However, if starting of the internal combustion engine is completed within the preset time which is taken to heat the hot wire of the air flow meter in this system, the fuel quantity corresponding to the engine coolant temperature is injected also after the completion of the engine starting, resulting in a poor controllability. If starting of the engine is not completed within the preset period of time for heating the hot wire of the air flow meter, the fuel injection is operated based upon the erroneous output value of the hot wire air flow meter on completion of starting of the engine, resulting in problems such as worsened emission, poor drivability and engine stall.

SUMMARY OF THE INVENTION

It is therefore an object of the present invention to provide an internal combustion engine control apparatus which is capable of performing various controls based upon the intake air quantity immediately after activation of a hot wire air flow meter.

It is another object of the present invention to provide a apparatus for controlling fuel fed to an internal combustion engine which is capable of optimally switching from a constant fuel quantity supply mode on starting of the engine to a variable fuel quantity supply mode depending upon the intake air quantity detected by a hot wire air flow meter.

In order to accomplish the above mentioned object, the present invention in one aspect provides an internal combustion engine control apparatus comprising a hot wire air flow meter provided in an air intake pipe of the internal combustion engine; controlled quantity calculating means for calculating the controlled quantity of the engine based on the output of said hot wire air flow meter; smoothing means for performing a smoothing processing on the controlled quantity calculated by said controlled quantity calculating means; control means for controlling said internal combustion engine based on the controlled quantity of said engine which is subjected to said smoothing processing, in which smoothing processing prohibiting means for prohibiting the smoothing processing by said smoothing means until a predetermined period of time has lapsed after turning on of a key switch of the internal combustion engine.

In the present invention which is formed in such manner, the controlled quantity calculating means calculates a controlled quantity of the engine based on the output of the hot wire air flow meter. If the predetermined period of time has lapsed after turning on of the key switch, the smoothing means performs the smoothing processing on the controlled quantity which is calculated by the controlled quantity calculating means. The control means then controls the internal combustion engine based on the controlled quantity of the internal combustion engine which is subjected to the smoothing processing. Accordingly, control which is performed on the internal combustion engine by the control means can be prevented from abruptly changing.

The smoothing processing prohibiting means prohibits the smoothing means to perform the smoothing processing of the controlled quantity of the engine until the predetermined period of time has lapsed after turning on of the key switch of the engine. Accordingly, the controlled quantity of the engine which is calculated after the lapse of the predetermined period of time is not influenced by the controlled quantity which is calculated until the predetermined period of time has lapsed.

Therefore, control of the internal combustion engine can be performed based on the intake air quantity immediately after the activation of the hot wire air flow meter by presetting a period of time which is taken to activate the hot wire air flow meter, that is, the period of time which lapses until the output of the hot wire air flow meter corresponds to the intake air quantity of the engine as the predetermined period of time.

The fuel injection quantity can thus correspond to the intake air quantity after the activation of the hot wire air flow meter if the present invention is applied to control of the fuel injection quantity, for example. As a result of this, the air/fuel ratio of the internal combustion engine is controlled to be equal to the stoichiometric air/fuel ratio immediately after the activation of the hot wire air flow meter. Emissions and fuel consumption can be remarkably improved.

In another aspect of the present invention to accomplish the second object thereof, the internal combustion engine for controlling a current to keep the temperature of a hot wire heated with the current at a constant value and for outputting the current value as a voltage value, first control means supplies the internal combustion engine with a fuel quantity corresponding to at least the temperature of an engine coolant for starting the internal combustion engine before the completion of the internal engine starting detected by said starting completion detecting means after starting of power supply to the hot wire of the hot wire air flow meter started by turning on of the key switch, second control means supplies the internal combustion engine with a fuel quantity corresponding to the intake air quantity detected by the hot wire air flow meter and the engine rotation number detected by said rotation number detecting means when the output value of said hot wire air flow meter or a value corresponding thereto is less than a predetermined value on completion of the engine starting detected by said starting completion detecting means; and third control means supplies said internal combustion engine with a fuel quantity corresponding to at least the engine coolant temperature or a predetermined fuel quantity for optimal fuel injection for a predetermined period of time after the time when the output value of said hot wire air flow meter or a value corresponding thereto in larger than a predetermined value on completion of the engine starting detected by said starting completion detecting means and supplies said internal combustion engine with a fuel quantity corresponding to the intake air quantity detected by the hot wire air flow meter and the engine rotation number detected by said rotation number detecting means after the lapse of the predetermined period of time.

When the hot wire of the meter is heated up to a constant temperature on completion of starting of the engine, the fuel quantity is directly influenced by the output value of the hot wire air flow meter. If the supply voltage to the meter is lowered due to lowering of the battery voltage so that it takes an extended period of time to heat the hot wire to a predetermined temperature, the engine is supplied with a predetermined fuel quantity corresponding to the coolant temperature for optimal fuel injection for a given period of time after completion of the starting of the engine and is then supplied with a fuel quantity based upon the output value of the meter. If the hot wire of the meter is not heated up to a constant temperature on completion of the engine starting and the fuel quantity is directly influenced by the output value of the meter, the air/fuel ratio becomes a fuel rich ratio. In contrast to this, this phenomenon is prevented from occurring in the present invention.

DESCRIPTION OF THE PREFERRED EMBODIMENTS

Preferred embodiments of the present invention will now be described in detail with reference to drawings. It is to be understood that the present invention is not limited to only these embodiments and various alternations and modifications are possible within the spirit and scope of the invention defined in the annexed Claims.

Figure 1:
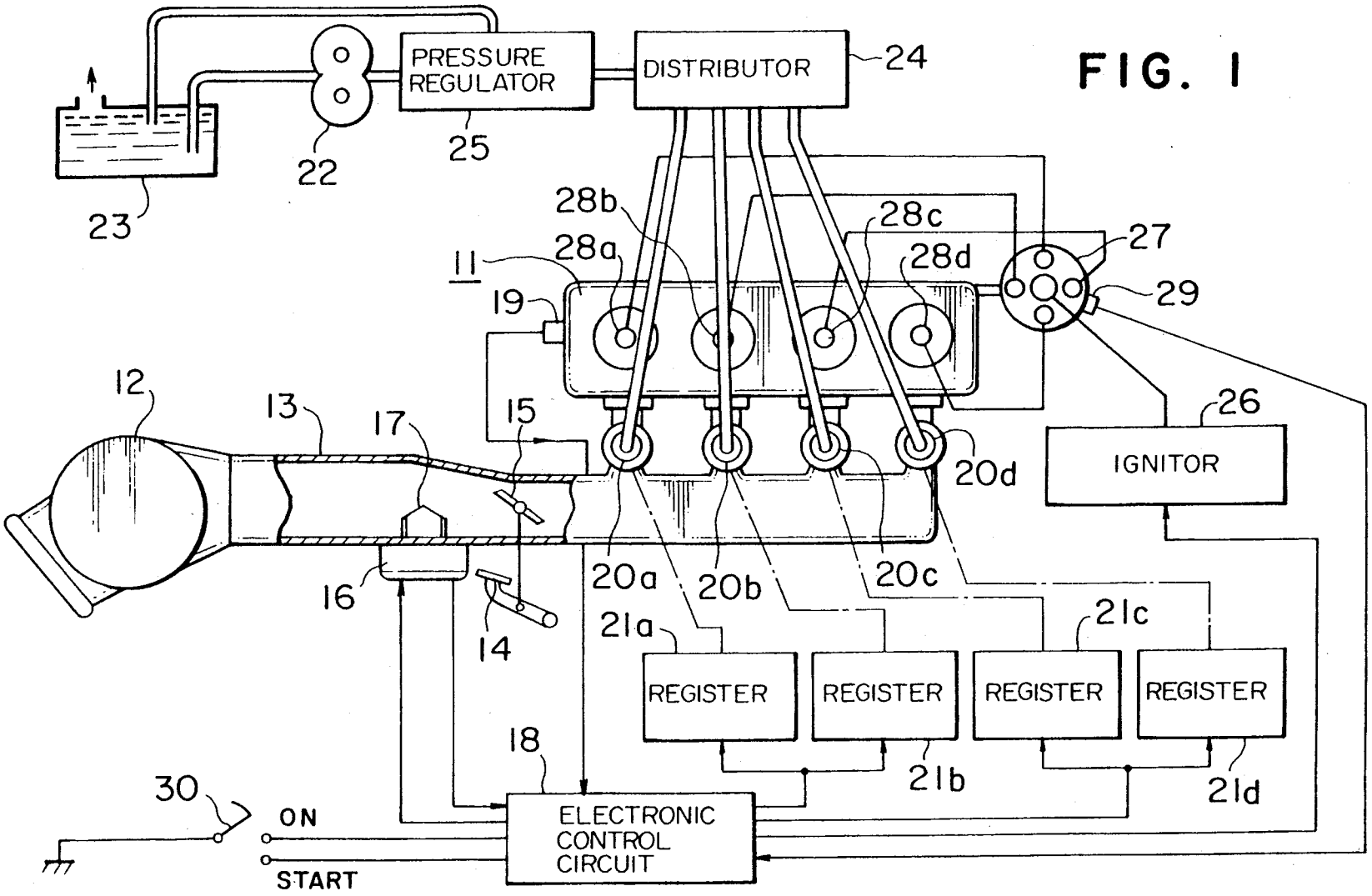
FIG. 1 is a schematic view showing the apparatus configuration of an embodiment of the present invention.

FIG. 1 shows a control apparatus for a four-cylinder gasoline internal combustion engine (hereinafter referred to simply as "internal combustion engine") for electronically controlling the fuel injection quantity and the like in response to operation conditions. Intake air from an air filter 12 is admitted via an intake pipe 13 and is supplied to each cylinder of the internal combustion engine 11 via a throttle valve 15 which is driven by an accelerator pedal 14. A thermosensitive element 17 of a hot-wire type air flow meter (hereinafter referred to simply as "air flow meter") 16 is mounted within the air intake pipe 13. The thermosensitive element 17 is composed of a heater, the heat generated from which is controlled with a current flowing therethrough and which is made of, for example, platinum having a temperature responsive resistance characteristic in which resistance changes with temperature.

An electronic control circuit 18 supplies the air flow meter 16 with an electric current so that the thermosensitive element 17 is heated up to a given temperature and detects the intake air quantity from the magnitude of the supplied current. In the following description, the intake air quantity which is calculated from the current conducted through the air flow meter 16 is referred to as detected air quantity G (measurement) for making a distinction from actual intake air quantity. The electronic control circuit 18 is a well-known microcomputer mainly including CPU, ROMs and RAMs which form logical and arithmetic circuits.

The electronic control circuit 18 is supplied with detection signals representing operating condition of the internal combustion engine 11 such as a detection signal from a rotation sensor 29, a detection signal from a coolant temperature sensor 19 provided in a water jacket of the internal combustion engine 11, an exhaust gas temperature detection signal and an air/fuel ratio detection signal which will be described hereafter. The electronic control circuit 18 calculates a fuel injection quantity which is adapted to the current operation condition of the internal combustion engine 11 based upon these detection signals and supplies corresponding injectors 20*a*, 20*b*, 20*c* and 20*d* of the cylinders of the internal combustion engine 11 with fuel injection time width signals via registers 21*a*, 21*b*, 21*c* and 21*d*, respectively. This causes the opening of the valves of the injectors 20*a*, 20*b*, 20*c* and 20*d* to be controlled for presetting the fuel injection quantity.

Fuel which is pumped from a fuel tank 23 by a fuel pump 22 is supplied via a fuel distributor 24 to the injectors 20*a*, 20*b*, 20*c* and 20*d* which are provided for respective cylinders of the internal combustion engine 11. The pressure of the fuel which is supplied to the distributor 24 is controlled to a constant value by a pressure regulator 25. Accordingly, the fuel injection quantity is accurately controlled with the valve opening period of time of the injectors.

The electronic control circuit 18 also gives an instruction to an ignitor 26 for distributing ignition signal via the distributor 27 to ignition plugs 28*a*, 28*b*, 28*c* and 28*d* which are provided for respective cylinders. The distributor 27 is provided with a rotation sensor 29 which generates one pulse per two rotations of a crank shaft.

A key switch 30 provided on an instruction panel is connected to the electronic control circuit 18. The key switch is well-known as having an ON contact for starting power supply to components in the control system and a START contact for driving a starter (not shown). When the internal combustion engine 11 is started by the actuation of the key switch 30, the electronic control circuit 18 controls the fuel injection quantity by changing the valve opening period of time of the injectors 20*a* through 20*d*. Now, the fuel injection quantity calculating processing for calculating a target value of the control for the fuel injection quantity will be described with reference to the flow chart of FIG. 2. This processing is executed at predetermined intervals during operation of the internal combustion engine 11.

When the processing is started, the engine rotation number Ne is read based upon the output from the rotation sensor 29 at step 101. The detected air quantity G is read based upon the output from the air flow meter 16 at next step 103. The basic injection quantity TP is calculated based on the engine rotation number Ne and the detected air quantity G at next step 105. Control proceeds to step 107. Since the processing for calculating the basic injection quantity TP based upon the engine rotation number Ne and the detected air quantity G is well known, it will not be described in detail herein.

At step 107, determination is made whether or not the operation condition of the internal combustion engine 11 is in a smoothing prohibition area which will be described hereafter. If the internal combustion engine 11 is steadily operated, it is determined that the condition is not in the smoothing prohibition area and program control proceeds to step 109. At step 109, the smoothing rate X is set to 0.5. At next step 111, the basic injection quantity is subjected to smoothing processing which is represented by the following formula.

$$TPA(i)=TPA(i-1)\cdot X+TP(i)\cdot(i-X) \quad (1)$$

If X=0.5 in this formula, a so-called a half smoothing is executed in which an average between the last calculated smoothed injection quantity TPA(I−1) and the basic injection quantity TP(i) which is currently calculated at step 105. At next step 113, an operated injection quantity Ti is calculated by multiplying the calculated rounded injection quantity TPA by a given constant K and processing is temporarily completed.

On the other hand, if it is determined that the condition is in the smoothing prohibition area, program control proceed to step 115 at which the smoothing rate X is set to 0. Then program control proceeds to step 111 at which the rounded injection quantity TPA is calculated in accordance with formula (1). In this case, the basic injection quantity TP is directly changed to the smoothed injection quantity TPA. In other words, without performing any smoothing processing for the basic injection quantity TP calculated at step 105, program control passes to step 113 at which the operation injection quantity Ti is calculated. Now, the above mentioned smoothing prohibition area will be described.

Figure 3:
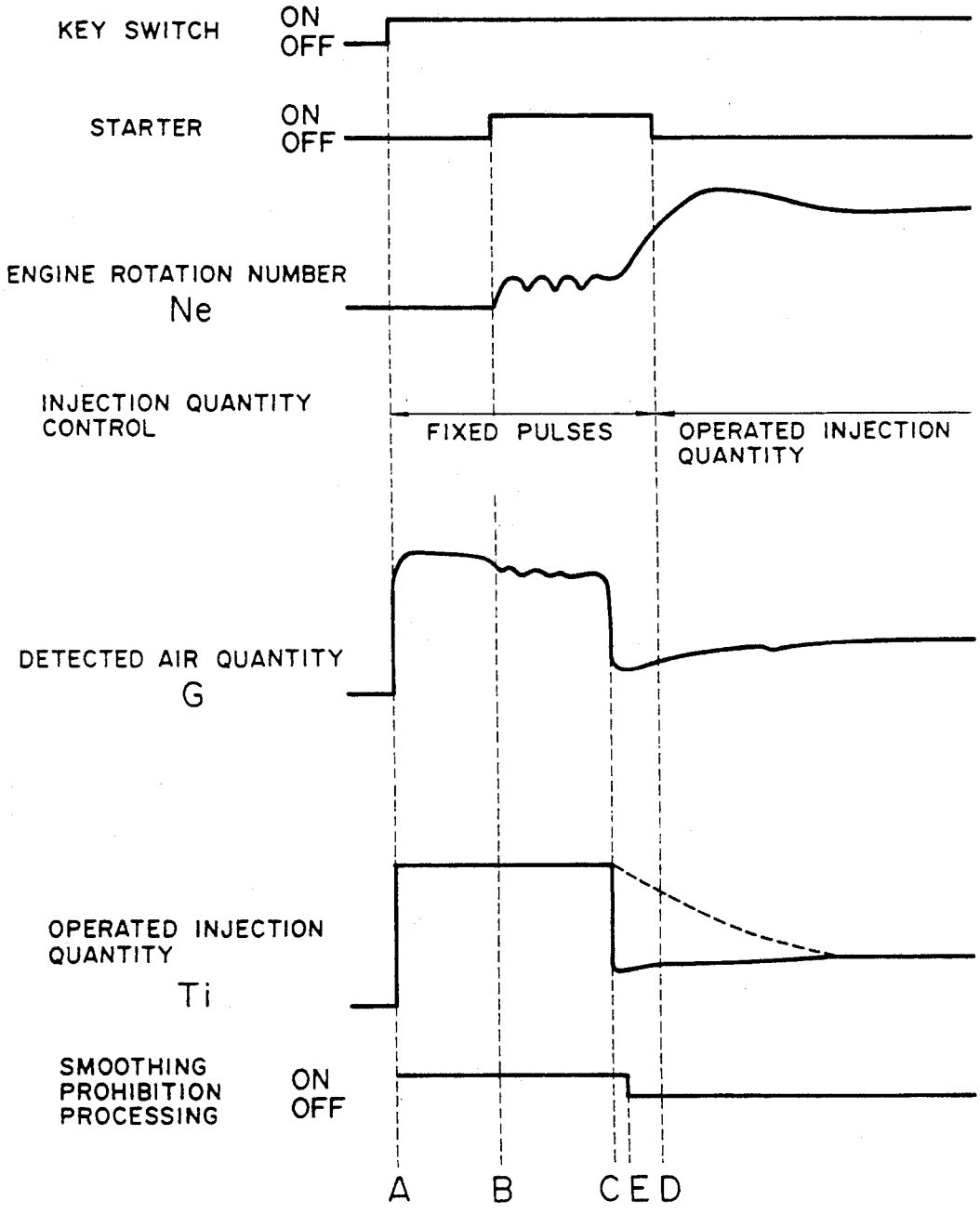
FIG. 3 is a timing chart showing changes in variables on starting of an internal combustion engine of the embodiment.

Referring now to FIG. 3, there is shown a timing chart showing changes in various variables on starting of the internal combustion engine 11. When the key switch 30 is turned to the position ON (at time A) as shown in the drawing, power supply to components in the control system for the internal combustion engine 11 is started. A large current is supplied to the air flow meter 16, for example, until the thermosensitive element 17 is heated up to a given temperature to make it possible to detect the intake air quantity, that is, until the air flow meter 16 is activated. Since the electronic control circuit 18 calculates the detected air quantity G based upon the conducted current to the air flow meter 16 as mentioned above the detected air quantity G at this time is remarkably high as is different from the actual intake air quantity. Therefore, the operated injection quantity Ti which is calculated based upon the detected air quantity G is also remarkably high. The range in which the operated injection quantity Ti can assume is preliminarily set in the ROM of the electronic control circuit 18. The operated injection quantity Ti at this time is kept to the maximum value.

When the key switch 30 is rotated to a position START (at the time B), the starter is driven so that the internal combustion engine 11 begins to rotate. That is, the engine rotation number Ne begins to increase. Since the battery voltage B is lowered after the starter has been driven, the conduction current to the air flow meter 16 decreases. Accordingly, the operated injection quantity Ti is still kept to the maximum value although the detected air quantity G slightly decreases.

When the air flow meter 16 is activated (at the time C), the detected air quantity G becomes a value corresponding to the actual intake air quantity. In association with this, the operated injection quantity Ti also becomes an appropriate fuel injection quantity corresponding to the actual intake air quantity. Subsequently, when a driver releases his or her hand from the key after completion of starting of the internal combustion engine 11, the key switch 30 is returned to a position ON (at the time D).

Figure 4:
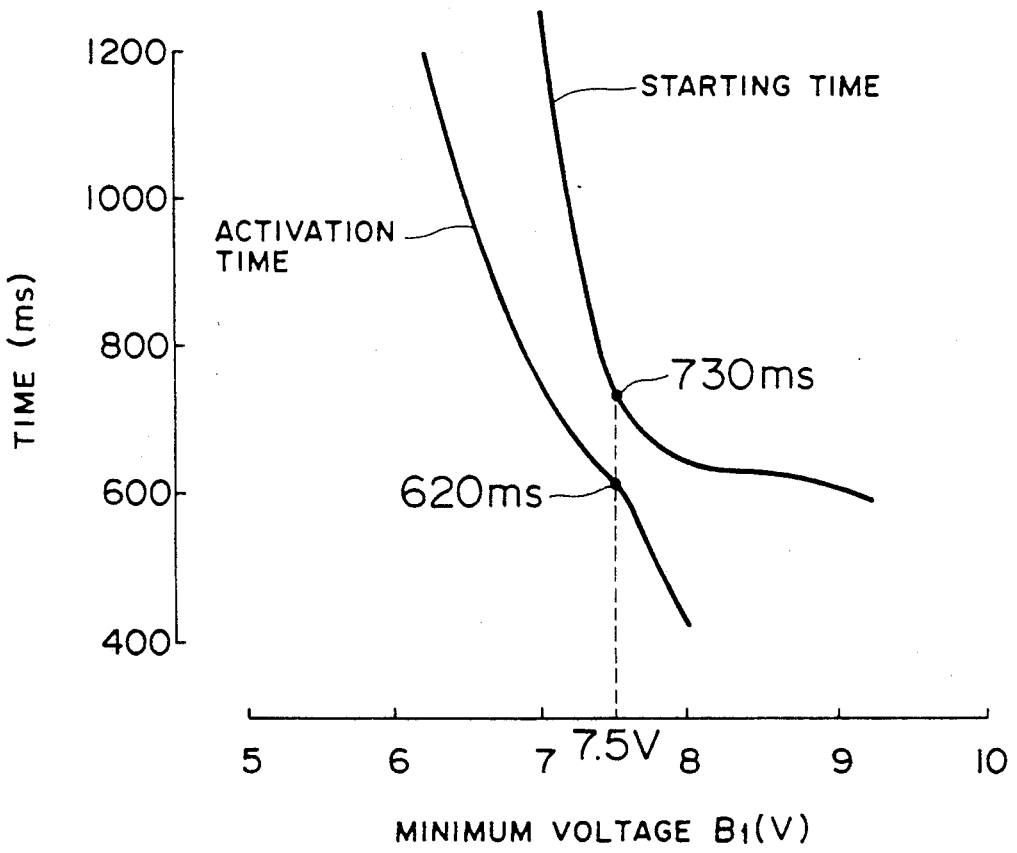
FIG. 4 is a map showing the relation between the batter voltage and the activation and starting times.

Description has been made assuming that the time C when the air flow meter 16 is activated is earlier than the time D when starting of the internal combustion engine 11 is completed. There is a relation as exemplarily shown in FIG. 4 between the period of time which is taken since the key switch 30 is rotated to the position ON until the air flow meter 16 is activated (starting time) and the period of time which is taken since the key switch 30 is rotated to the position START until the starting of the internal combustion engine 11 is completed (starting time).

Both the activation and starting periods of time ar shortened as the battery voltage B at the moment when the starter begins to rotate (hereinafter referred to as "minimum voltage B1", refer to FIG. 6), the activation period of time is always shorter than the starting period of time independently of the minimum voltage B1. If the minimum voltage B1 is, for example, 7.5 volts, the activation and starting periods of time are 620 and 730 ms, respectively. Accordingly, also in so-called quick starting case in which the key switch 30 is continuously rotated to the position START immediately after it is rotated to the position ON, the air flow meter 16 has been started when starting of the internal combustion engine 11 is completed.

Now returning to FIG. 3, the operated injection quantity Ti well corresponds to the actual intake air quantity after the time D in such a manner. Therefore, the electronic control circuit 18 outputs pulses corresponding to the operated injection quantity Ti to the registers 21*a* through 21*d* in accordance with another routine (not illustrated) for controlling the fuel injection quantity. Before the time D, the electronic control circuit 18 outputs fixed pulses which are calculated based upon the temperature of the coolant detected by the coolant temperature sensor 19 for controlling the fuel injection quantity.

The controlled quantity such as fuel injection quantity gives a great influence upon the drive condition of an engine. For example, as the fuel injection quantity sharply changes, the output torque sharply changes. Therefore, the operated controlled quantity is generally subjected to smoothing processing to prevent the controlled quantity from sharply changing.

If smoothing processing is applied to the operated injection quantity Ti on starting of an internal combustion engine, a problem will arise as follows: At times A through C, an excessive operated injection quantity Ti is calculated for the actual intake air quantity as mentioned above. If the smoothing processing is applied at this time, the operated injection quantity Ti after the time D is also influenced as represented by a dotted line in the drawing. When the electronic control circuit 18 switches the fuel injection control based on the coolant temperature to the fuel injection control based upon the operated fuel injection quantity Ti at the time D, the fuel injection quantity becomes excessive so that the air/fuel ratio becomes an excessive fuel rich ratio.

Hence, in the present embodiment, the time E when the air flow meter 16 is activated is preset by a processing which will be described hereafter. The smoothing processing is prohibited in the smoothing prohibition period from the time A to the time E. A smoothing prohibition period calculating processing for calculating the period of time from the time A to the time E (hereinafter referred to "smoothing prohibition period of time") which is executed in the electronic control circuit 18 will be described with reference to the flow chart of FIG. 5. This processing is started when the key switch 30 is rotated to the position START.

Enough conduction time Ti which is taken to complete the activation of the air flow meter 16 when the battery voltage B is 12 volts, that is , when the internal combustion engine 11 is not started while the key switch 30 is rotated to the position ON is preset and stored in the ROM of the electronic control circuit 18. After the processing is started, the conduction time Ti is read at step 201. At following step 203, the period of time T2 from the time A when the key switch 30 is rotated to the position ON to the time B when the key switch 30 is rotated to the position START so that the starter begins to be driven is counted. At following step 205, determination as to whether the conduction time T1 is longer than the period of time T2 is made. If it is determined that $T1 \leqq T2$, that is, it is determined that the conduction time T1 has already lapsed when the key switch 30 is rotated to the position START, the smoothing prohibition period of time T1 is assumed as T2 and processing is completed at step 209. If it is determined that $T1 \geqq T2$ at step 205, program control proceeds to step 209 at which the minimum voltage B1 which is the battery voltage B at the moment when the starter begins to be driven is measured.

Figure 6:
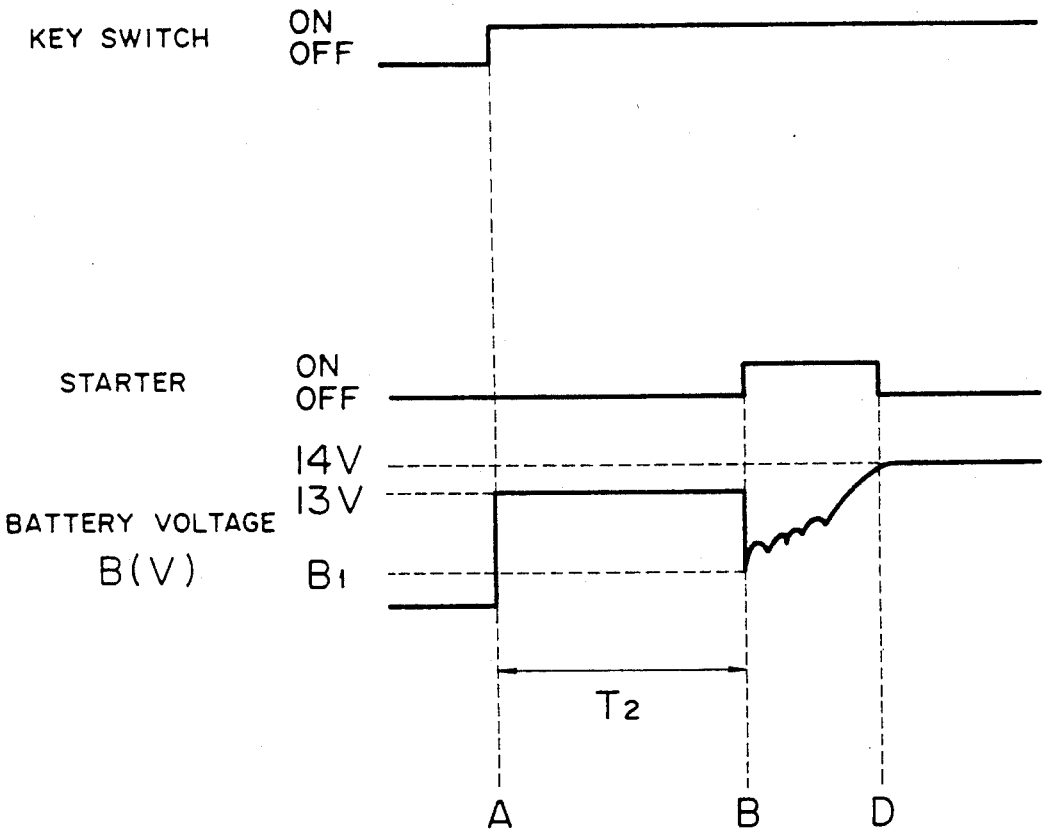
FIG. 6 is a timing chart showing a change in battery voltage with time by the operation of a key switch.

When the key switch 30 is rotated to the position B (at time A), the battery voltage B is kept at 12 V as exemplarily shown in FIG. 6. When the key switch is then rotated to the position START (at time B), the battery voltage B is temporarily sharply lowered due to conduction of the drive current to the starter and thereafter gradually increases. After the completion of starting of the internal combustion engine 11 (at time D), the battery voltage B is kept at 14 V by charging from an alternator (not shown). At step 209, the minimum voltage B1 at the time B is measured.

Figure 7:
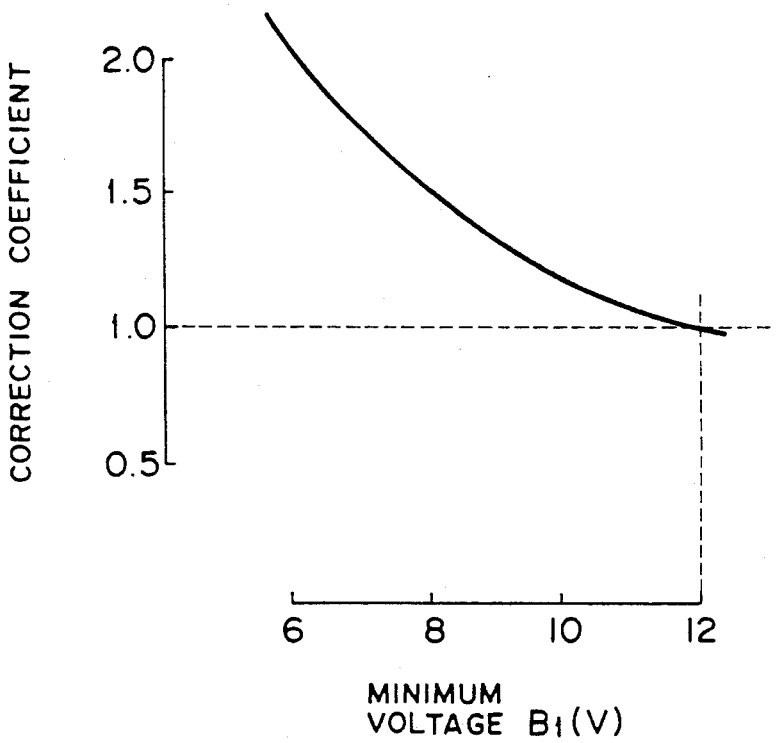
FIG. 7 is a map showing the relation between the smoothing prohibition period correction quantity and the battery voltage.

Then, program control passes to step 211 at which a correction coefficient Z corresponding to the measured minimum voltage B1 is read from a map shown in FIG. 7. At next step 213, the smoothing prohibition perid of time T is calculated in accordance with the following formula and the processing is ended.

$$T = T2 + (T1 - T2) \cdot Z$$

The map shown in FIG. 7 is prepared based on the data which is calculated from the above mentioned formula assuming as the smoothing prohibition time T the time which is enough to activate the air flow meter 16 since the key switch 30 is rotated to the position ON for various minimum voltages B1.

In such a manner, the main routine calculates the smoothing prohibition period of time T which is enough to activate the air flow. The following advantage is obtained by prohibiting the smoothing processing for this period (times A to B). In other words, the fuel injection quantity after the time D can be prevented from being influenced by the operated injection quantity Ti corresponding to no actual intake air quantity, which is calculated before the time D. Therefore, if fuel injection quantity control is executed based upon the operated injection quantity Ti at the time D, fuel injection quantity control corresponding to the actual intake air quantity can be immediately performed.

If the key switch 30 is rotated to the position START after the lapse of the conduction time T1, that is after the air flow meter has been activated, smoothing processing can be immediately executed by making T=T2.

In the present embodiment, smoothing processing can be prohibited before the time E between the times C and D by providing a smoothing prohibition period of time since the key switch 30 is rotated to the position ON until the smoothing prohibition period of time T which is calculated by the above mentioned processing has lapsed. Accordingly, the fuel injection quantity after the time D can be prevented from being influenced by the operated injection quantity Ti corresponding to no actual intake air quantity which as been calculated before the time C. Therefore, fuel injection quantity control corresponding to the actual intake air quantity can be immediately performed if fuel injection quantity control is performed based upon the operated injection quantity Ti at the time D. Since the smoothing processing is performed after the time E, an abrupt change in the fuel injection can be prevented from occurring.

Although a slight period of time is needed until the smoothed value of the operated injection quantity Ti is stabilized so that it can be used for the fuel injection quantity control, stable fuel injection quantity can be immediately executed from the time D since smoothing processing is started from the time E between the times C and D in the present embodiment.

Although the smoothing factor X is made 0 until a given period of time has lapsed from the turning on of the key switch in the present embodiment, the smoothing processing may be performed by making the smoothing factor X a given value (for example, 0.5) before a given period of time has lapsed similarly to the subsequent time and by operating a reference injection quantity based upon the detected intake air quantity only at the time when the given period of time has lapsed and by using the reference injection quantity as an initial value.

The given period of time for which the smoothing factor is made 0 may not be directly preset. Activation of the hot wire air flow meter may be detected from the output thereof. The smoothing factor may be made 0 at the time when the output of the air flow meter is lower than a given value.

Alternatively, activation of the hot wire air flow meter is detected from the output thereof in lieu of making the smoothing factor 0. If the output is not lower than a given value, the output of the air flow meter may be preset to a given value corresponding to the intake air quantity on idling. Smoothing processing may be conducted as is usually done.

In the above mentioned embodiment, steps 105; 109 and 111; and 107, 115 and the smoothing prohibition period calculating processing correspond to controlled quantity calculating means; smoothing means; and smoothing processing prohibition means, respectively, Although fuel injection quantity control has been described in detail in the foregoing embodiment, it is to be understood that the present invention is not limited to only fuel injection quantity control and may be embodied for various controls using the output of a hot wire air flow meter, such as EGR control.

Now, an embodiment in which switching is controlled from a constant fuel quantity supply mode on starting of an engine to a variable fuel quantity supply mode in which the fuel quantity is operated depending upon the intake air quantity indicated by a hot wire air flow meter will be described.

Figure 2:
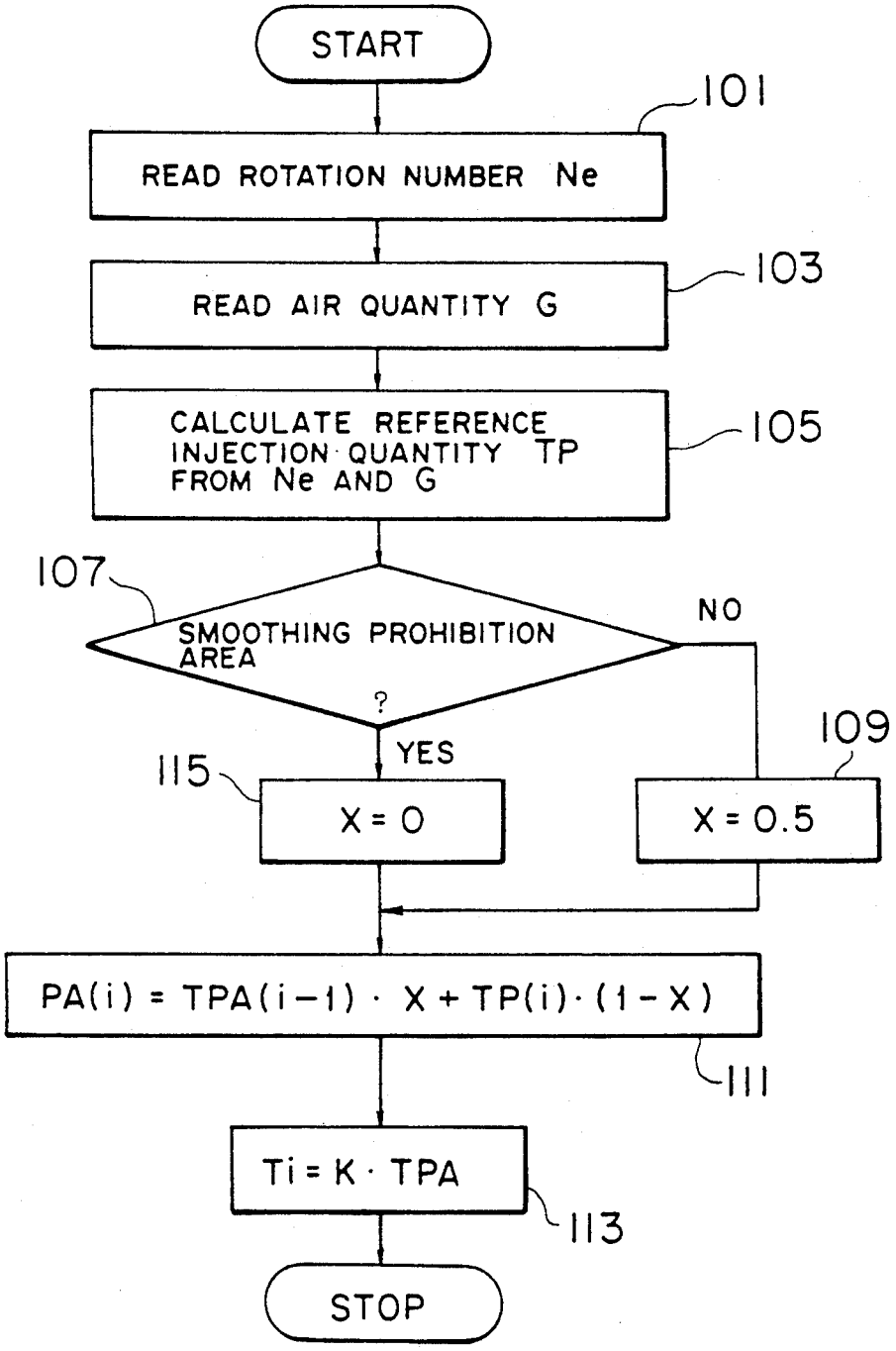
FIG. 2 is a flow chart showing a fuel injection quantity calculation processing in the embodiment.
Figure 5:
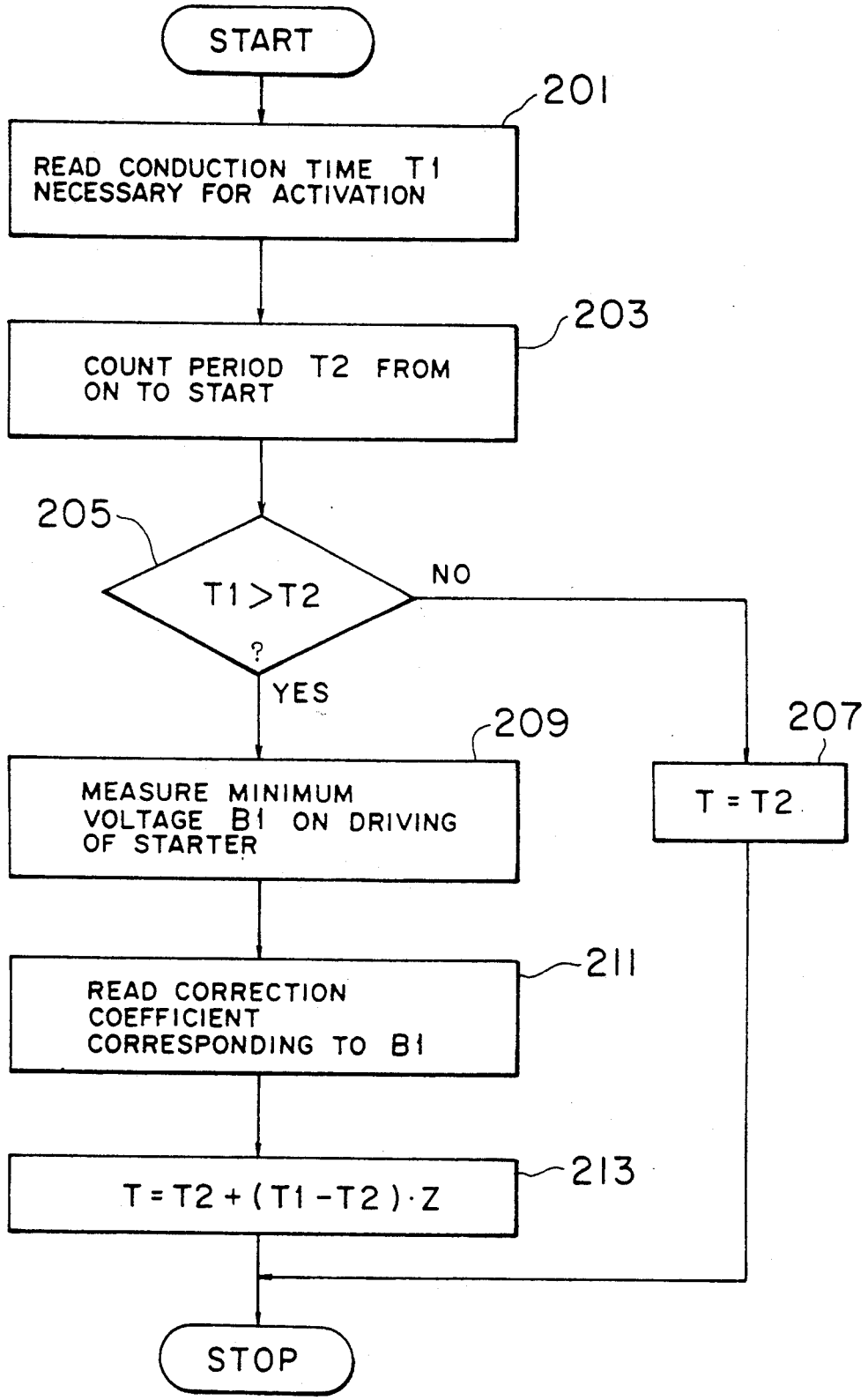
FIG. 5 is a flow chart showing a smoothing prohibition period calculating processing in the embodiment.

Additionally it should be appreciated that a smoothing processing is also appricable to the following embodiment in a similar way to that described with FIGS. 2 and 5.

Figure 8:
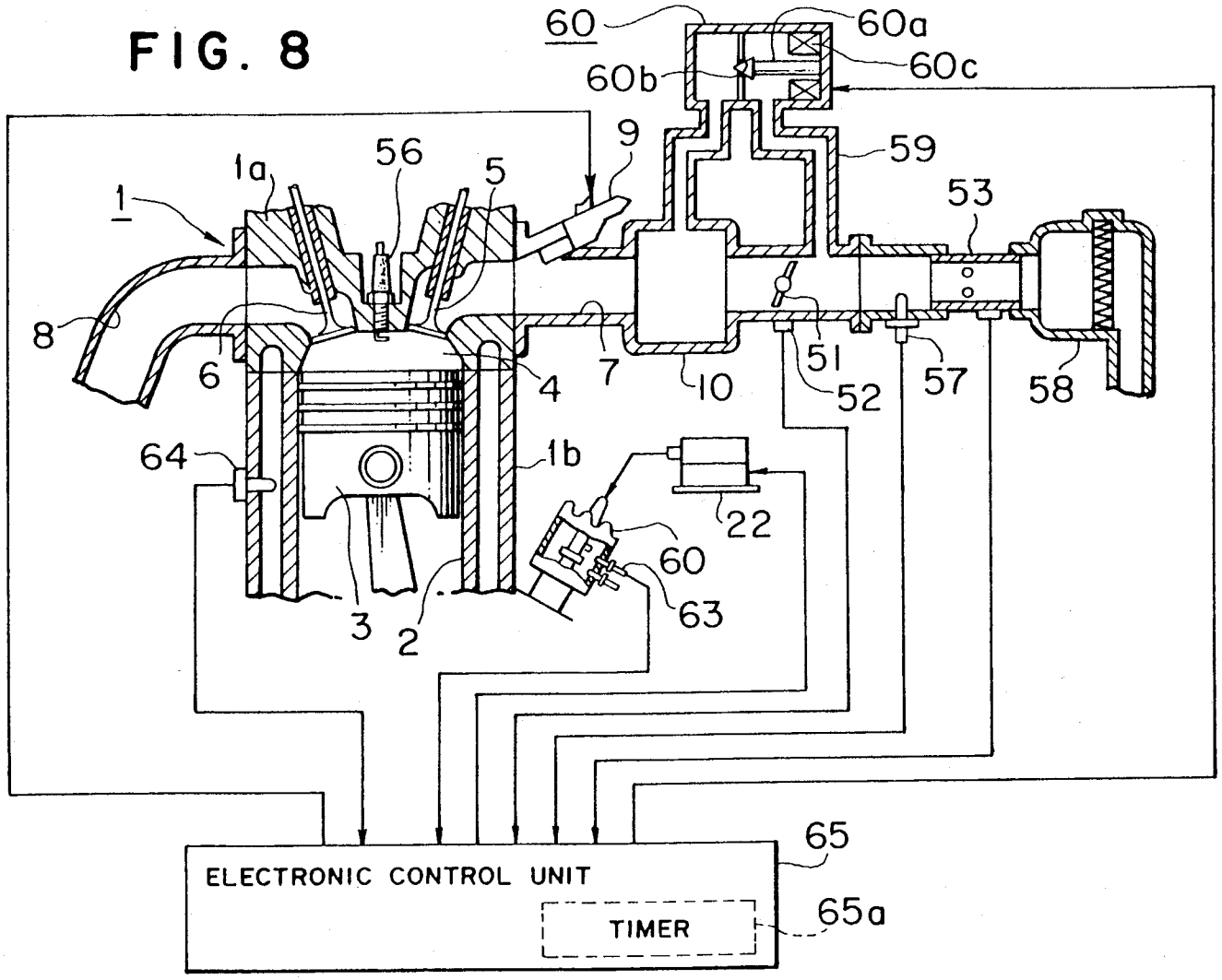
FIG. 8 is a schematic view showing an apparatus for controlling fuel to an internal combustion engine.

A fuel control apparatus for a multi-cylinder engine which is mounted (hereinafter referred to as "engine") on an automobile is shown in FIG. 8. The engine 1 comprises a piston 3 in each cylinder 2. A combustion chamber 4 which is defined by a cylinder head 1*a* and a cylinder block 1*b* is formed above the piston 3. An ignition plug 16 is provided in the combustion chamber 4. The combustion chamber 4 is communicated with an air intake passage 7 and an exhaust passage 8 via an air intake valve 5 and an exhaust valve 6, respectively.

A fuel injection valve 9 for each cylinder is provided in the air intake passage 7. A surge tank 10 is provided in the air intake passage 7 upstream of the fuel injection valve 9 for suppressing pulsation of the intake air when air is admitted. A throttle valve 51 which is opened or closed in association with the operation of an accelerator pedal (not shown) is provided upstream of the surge tank 10 for adjusting the quantity of the intake air to the air intake passage 7 by closing or opening the throttle valve 51.

A throttle sensor 52 for detecting the opening of the throttle valve 51 is provided in the vicinity of the throttle valve 51. A hot wire air flow meter (hereinafter referred to simply as "meter") 53 is provided upstream of the throttle valve 51.

Figure 9:
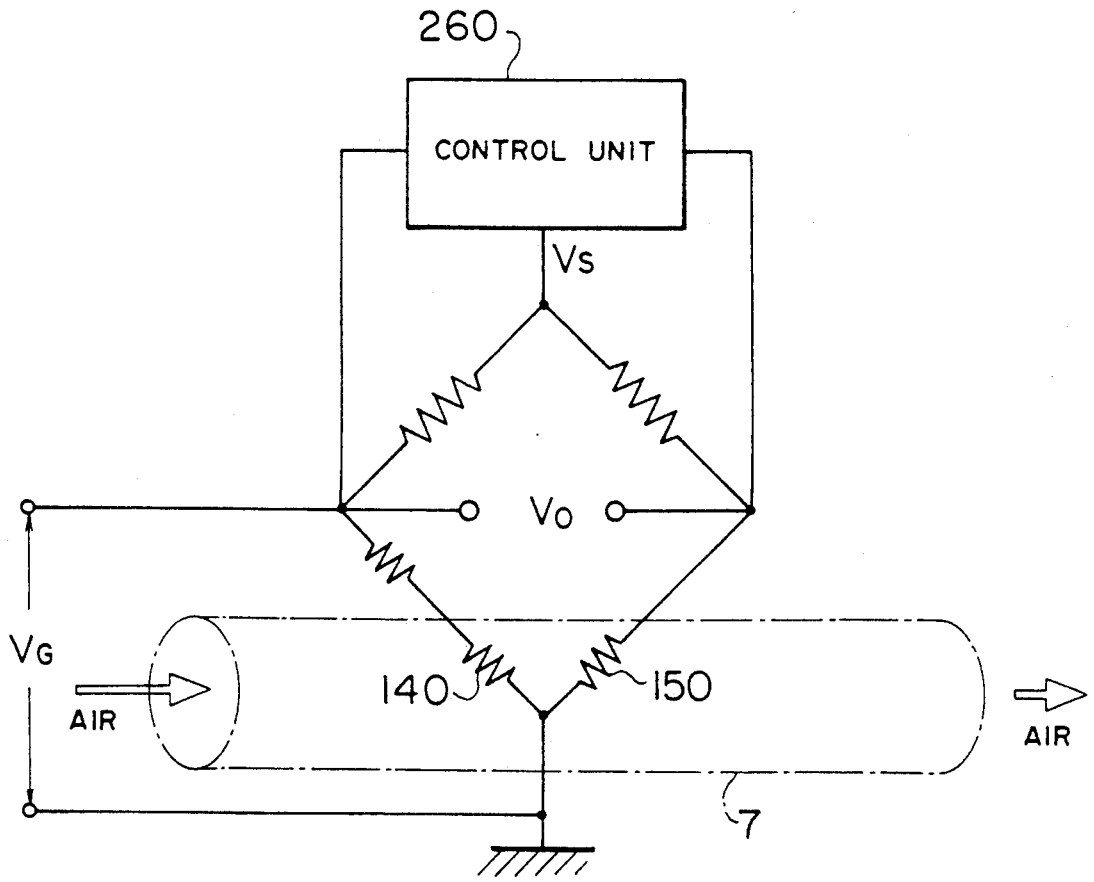
FIG. 9 is a view showing a hot wire air flow meter.

The structure of the meter 53 is shown in FIG. 9. A hot wire made of platinum (heating element) 140 is disposed in the air intake passage 7 and a temperature compensating resistor 150 is disposed downstream of the platinum hot wire 140. A bridge circuit is constituted by the platinum hot wire 140, the temperature compensating resistor 150, etc. A constant temperature is kept by controlling a voltage Vs by a control circuit 260 so that an unbalanced voltage Vo constantly becomes zero. In other words, the platinum hot wire 140 is disposed in an air stream and a current therethrough is controlled so that the temperature of the hot wire 140 which is heated with the current is kept at a constant value. The current value is output as a voltage value VG.

An intake air temperature sensor 57 for measuring the temperature of the intake air is provided between the meter 53 and the throttle valve 51 as shown in FIG. 8. An air cleaner 58 is provided upstream of the meter 53.

Accordingly, air which is intaken through the air cleaner 58 flows through the meter 53, the throttle valve 51 and the surge tank 10 along the intake passage 7 in a downstream direction and is mixed with the fuel injected from the fuel injection valve 9 into an air/fuel mixture. The mixture is admitted into the combustion chamber 4 via the intake valve 5 and the engine 1 combusts the mixture in the combustion chamber 4 with the ignition plug 56 to provide a driving power and then exhausts an exhaust gas to the exhaust passage 8 via the exhaust valve 8.

A bypass passage 19 is provided in the intake passage 7 to bypass the throttle valve 51 for communicating the upstream side of the throttle valve 51 with the surge tank 10. An idling rotation number control valve (hereinafter referred to as ISC valve) 60 is provided in the bypass passage 190 in a position along the length thereof. The ISC valve 20 includes a valve head 60*a* which is normally biased by a spring (not shown) in such a direction that it closes the valve seat 60*b*. Closing of valve seat 60*b* by the valve head 60*a* is released by energizing the solenoid 60*c*. Accordingly, energization and deenergization of the solenoid 60*c* of the ISC valve 60 causes the bypass passage 59 to be opened and closed, respectively. The opening of the ISC valve 60 is adjusted by duty ratio control based upon the pulse width modulation.

The distributor 61 distributes a high voltage output from the ignitor 62 to each ignition plug 56 in synchronization with the crank angle of the engine 1. The ignition timing of each ignition plug 56 is determined by the high voltage output timing from the ignitor 62. The distributor 61 is provided with a rotation number sensor 63 which detects the crank angle from the rotation of a rotor of the distributor 61 for outputting a pulse signal. The cylinder block 1*b* is provided with a coolant temperature sensor 64 for measuring the temperature of the temperature of the coolant in the engine 1.

The electronic control unit (hereinafter referred to as "ECU") 65 is mainly constituted by a microcomputer and includes an A/D converter, etc. The meter 53, the intake air temperature sensor 59, the rotation number sensor 63 and the coolant temperature sensor 64 are connected to the ECU 65 so that signals from respective sensors are input to the ECU 65. The fuel injection valves 9, the ISC valves 65 and the ignitors 62 are connected to the ECU 65 for outputting drive signals to respective driving components.

ECU 65 calculates (converts) the quantity of intake air from the output valve (output voltage VG) of the meter 53 by using the map.

In the present embodiment, the ECU 65 constitutes starting completion detecting means, first, second and third control means and the rotation number sensor 63 constitutes rotation number detecting means and the starting completion detecting means.

Operation of the thus formed fuel control apparatus of an internal combustion engine will be described.

Figure 10:
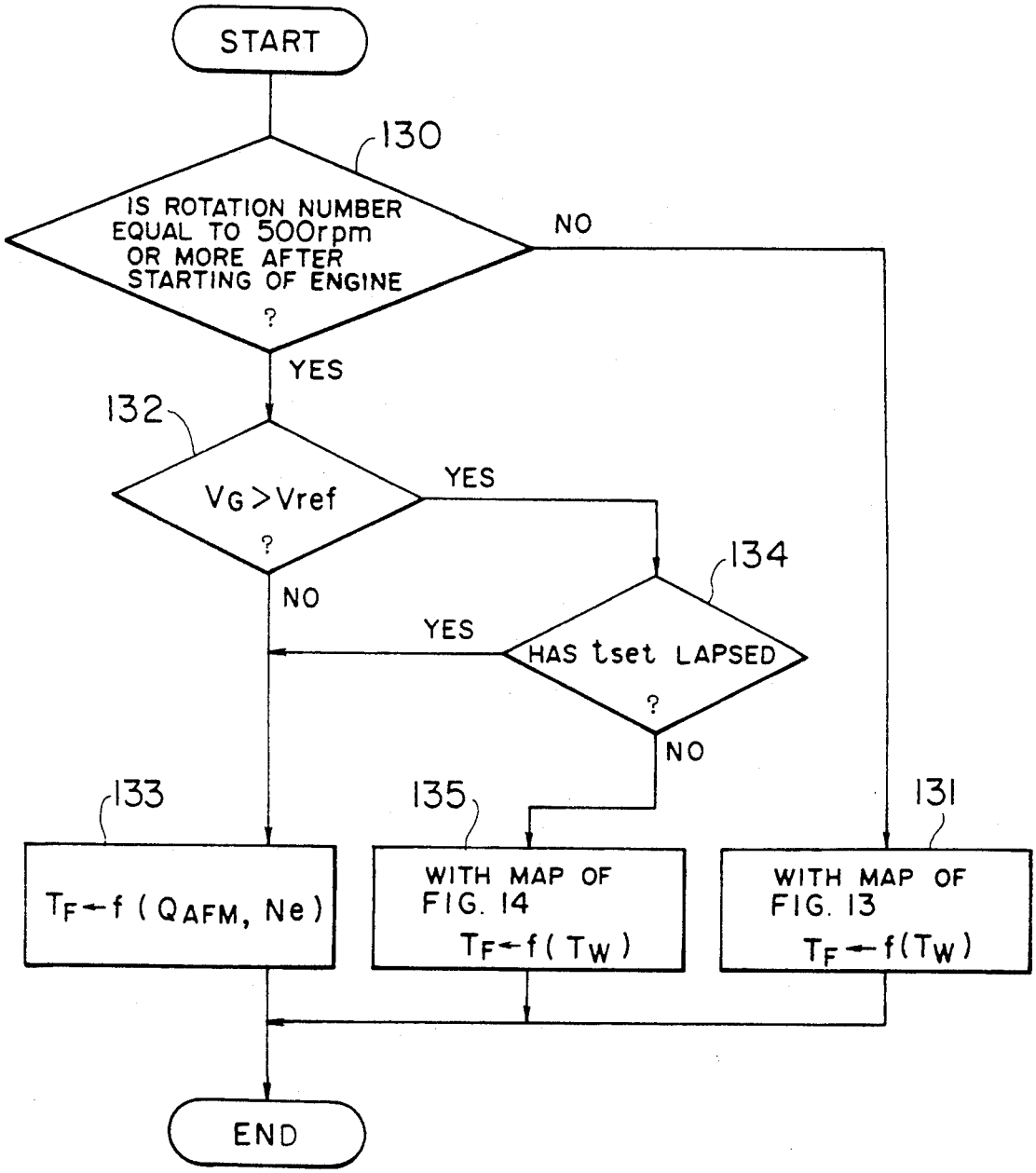
FIG. 10 is a flow chart explaining the operation.
Figure 11:
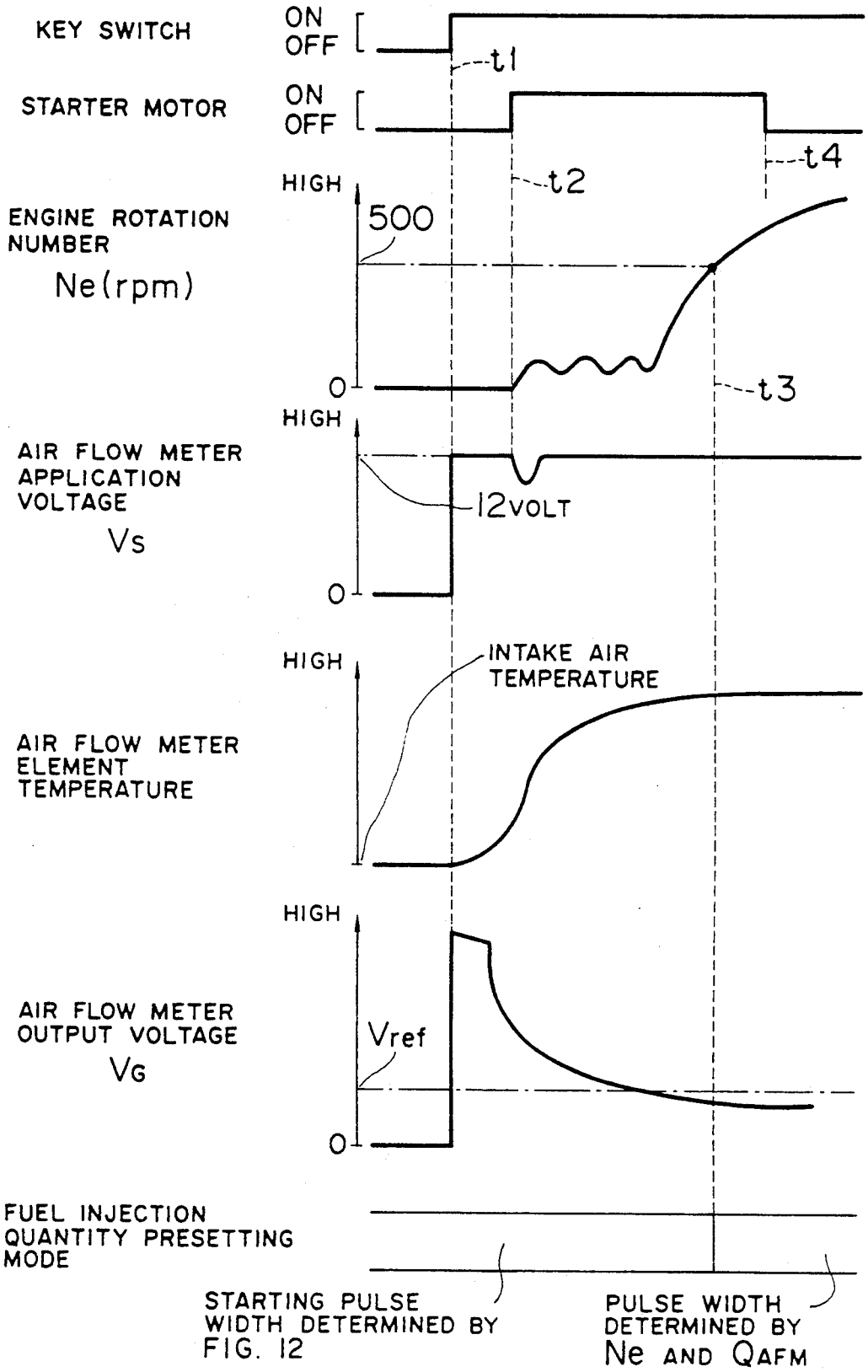
FIGS. 11 and 12 are timing charts explaining the operation.

A processing (flow chart) which is executed by the ECU 65 is shown in FIG. 10. This processing is activated at predetermined intervals. A timing chart of various signals is shown in FIG. 11. It is assumed in FIG. 11 that the key switch is turned on at the time t1 for starting the application of the battery voltage to the meter 53 and the starter motor is turned on at the subsequent time t2.

Figure 13:
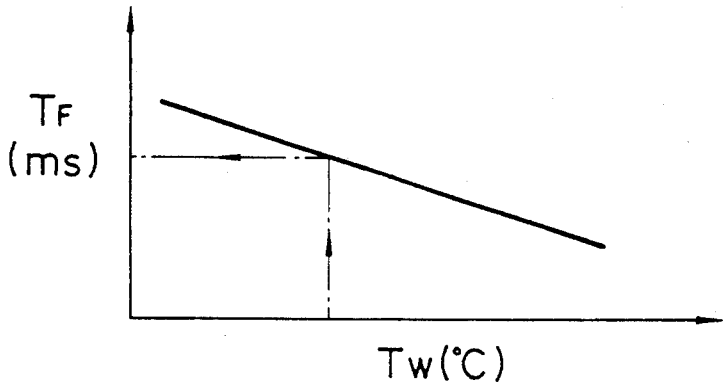
FIGS. 13 and 14 are maps for determining the fuel injection period of time.

The ECU 65 determines as to whether or not the rotation number firstly becomes 500 rpm after starting of the engine at step 130 in FIG. 10. If the rotation number is less than 500 rpm, program controls proceeds to step 131. The ECU 65 presets the fuel injection period of time (opening period of time of the fuel injection valve TF corresponding to the current engine coolant temperature Tw using the map shown in FIG. 13 for starting the engine at steps 131. For a period of times t1 to t3 in FIG. 11, steps 130 to 131 are repeated.

The ECU 65 causes program control to proceed to step 132 from step 130 in FIG. 10 when the rotation number firstly becomes 500 rpm after starting of the engine (at the time t3 in FIG. 11). The ECU 65 compares the output value VG of the meter 53 with a predetermined reference value Vref at step 132. The ECU 65 causes program control to proceed to step 133 if the output value VG of the meter 53 is less than the reference value Vref. The CPU 65 presets the fuel injection period of time (opening period of time of the fuel injection valve) TF corresponding to the intake air quantity QAFM measured by the meter 53 and the engine rotation number Ne measured by the rotation number sensor 63. After the time t3 in FIG. 11, steps 130 to 132 and 133 are repeated.

Figure 12:
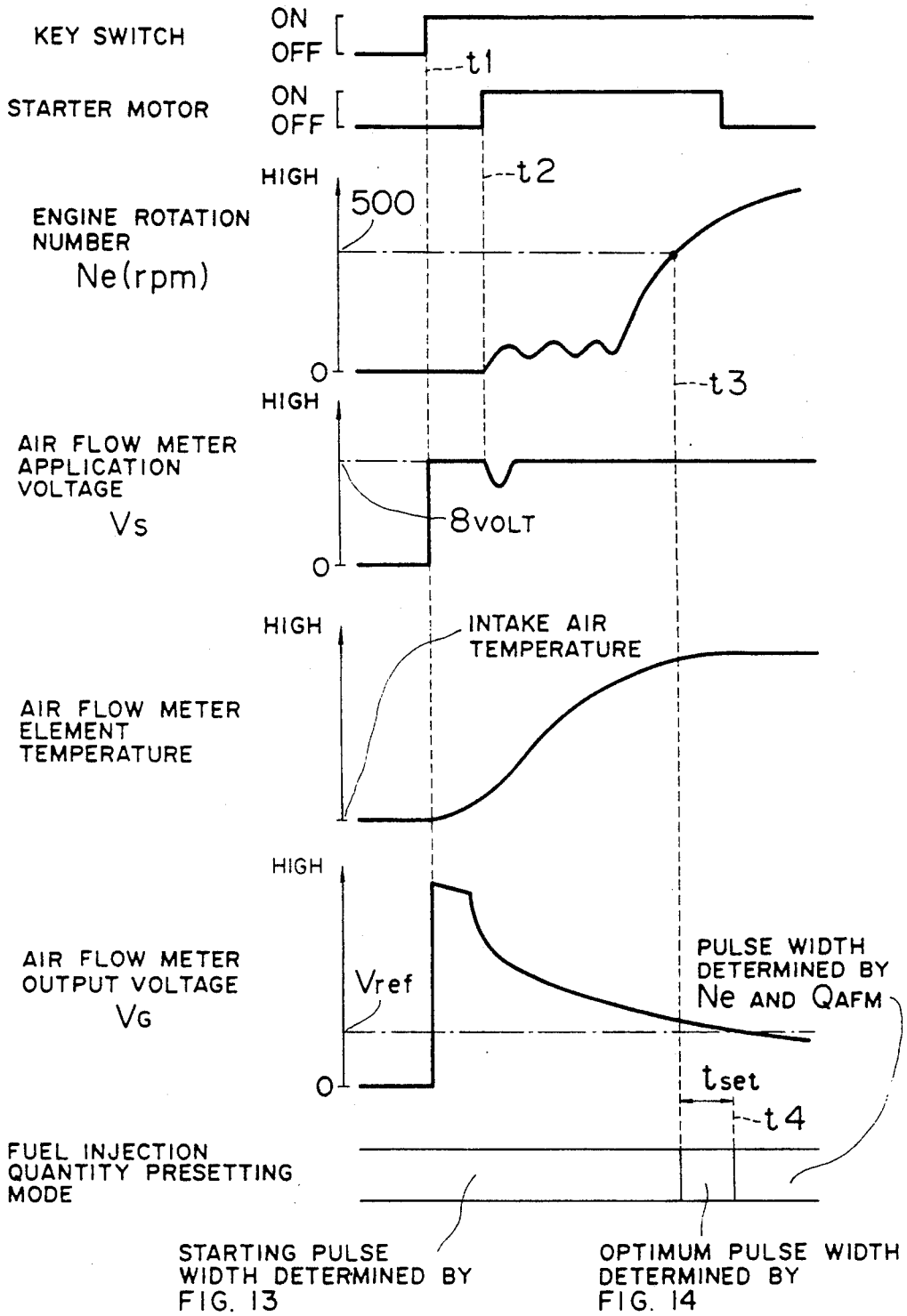

On the other hand, the ECU 65 causes program control to proceed to step 134 in FIG. 10 if the output value VG of the meter 53 is larger than the reference value Vref at step 132 as shown in FIG. 12. The ECU 65 starts counting of a timer 65*a* (shown in FIG. 8) when the engine rotation number becomes 500 rpm firstly after starting of the engine to determine whether or not the preset period of time t set has lapsed. When the preset time t set has not lapsed, the ECU 65 proceeds to step 135 at which it presets the fuel injection period of time (the opening period of time of the fuel injection valve) corresponding to the current engine coolant temperature TW by using a map shown in FIG. 14 for optimal fuel injection. For the period of time between t3 and t4 in FIG. 12, steps 13 to 132, 134 to 135 in FIG. 10 are repeated.

When the preset priod of time t set has lapsed since the rotation number becomes 500 rpm firstly after starting of the engine at step 104, the ECU proceeds to step 123 at which it presets the fuel injection priod of time (the opening period of time of the fuel injection valve) TF corresponding to the intake air quantity QAFM measured by the meter 53 and the engine rotation number Ne measured by the rotation number sensor 63. After the time t4 in FIG. 12, steps 130, 132, 134 and 133 or steps 130, 132 and 133 are repeated.

Fuel is injected from the fuel injection valve 9 at a given time at the fuel injection period of time TF which is preset at step 131, 133 and 135 in FIG. 10.

In such a manner in the present embodiment, the ECU 65 (starting completion detecting means, the first, second and third control means) determines whether or not starting of the engine is completed by determining as to whether the engine rotation number Ne become 500 rpm firstly after the starting of the engine. The ECU 55 supplies the engine with a fuel quantity corresponding to the engine coolant temperature TW of the engine for starting the engine before the completion of the engine starting after starting of the power supply to the hot wire of the meter 53 by turning the key switch on when the output value VG of the meter 52 is less than the given value (reference value Vref) on completion of the engine starting, the CPU 65 supplies the engine with a fuel quantity corresponding to the intake air quantity QAFM measured by the meter 53 and the engine rotation number Ne measured by the rotation number sensor 63. When the output value VG of the meter 53 is larger than the reference value Vref on completion of the engine starting, the ECU 65 supplies the engine with a fuel quantity corresponding to the engine coolant temperature TW for optimal fuel injection for a given period of time (preset period of time t set) and supplies the engine with a fuel quantity corresponding to the intake air quantity QAFM measured by the meter 53 and the engine rotation number Ne measured by the engine rotation number sensor 63.

When the hot wire of the meter 53 is heated up to a constant temperature on completion of starting of the engine, the fuel quantity is directly influenced by the output value of the hot wire air flow meter 53. As a result of this, the fuel quantity can be reflected by the output value of the meter at an appropriate time on restarting of the warmed up engine. The value when the output of the meter is normal can be most effectively used.

Figure 14:
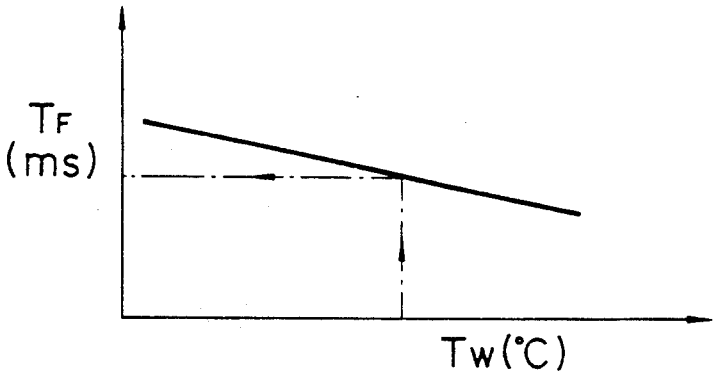

If the supply voltage Vs to the meter 53 is as low as 8 volts in contrast to the rated 12 volts in FIG. 11 for some reason such as lowering of the battery voltage as shown in FIG. 12 so that it takes an extended period of time to heat the hot wire to a predetermined temperature, the engine is supplied with a fuel quantity corresponding to the coolant temperature TW for optimal fuel injection using the map of FIG. 14 for a given period of time after completion of the starting of the engine and is supplied with a fuel quantity based upon the output value VG of the meter thereafter. If the hot wire of the meter 53 is not heated up to a constant temperature on completion of the engine starting and the fuel quantity is directly influenced by the output value of the meter 53, the air/fuel ratio becomes a fuel rich ratio. In contrast to this, this phenomenon is prevented form occurring in the present embodiment. When heating of the hot wire of the meter 53 is not completed, in other words, the output of the meter 53 represents a value which is larger than the actual air flow rate, the air/fuel ratio will not become a fuel rich ratio since the output of the meter 53 is not used. Problems such as worsening of emission, poor drivability immediately after starting of the engine and engine stall can be prevented from occurring.

The present invention is not limited to the foregoing embodiments. Although the fuel quantity for optimal fuel injection is the fuel quantity corresponding to the engine coolant temperature at step 135 in FIG. 10, the engine may be supplied with a predetermined fuel quantity.

Figure 15:
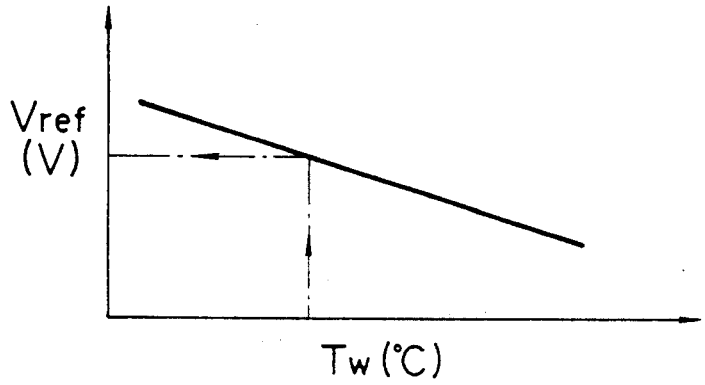
FIG. 15 is a map for determining a reference value.

The reference value Vref at step 132 in FIG. 10 may be a value corresponding to the engine coolant temperature TW as shown in at least FIG. 15.

Figure 16:
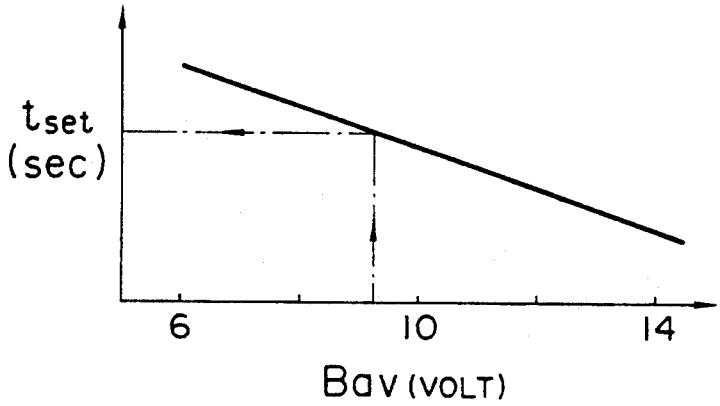
FIGS. 16, 17 and 18 are maps determining preset period of time.
Figure 17:
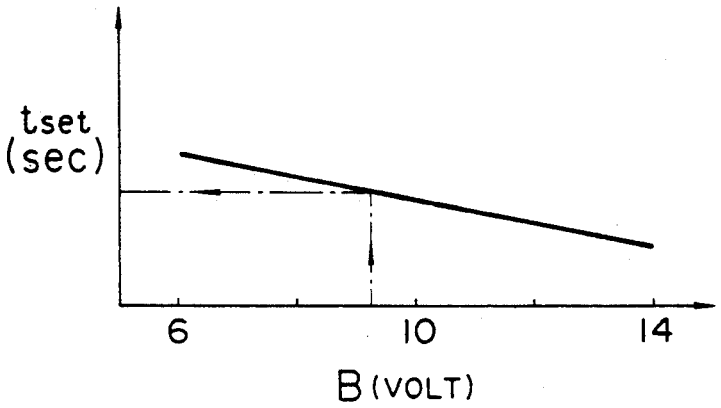
Figure 18:
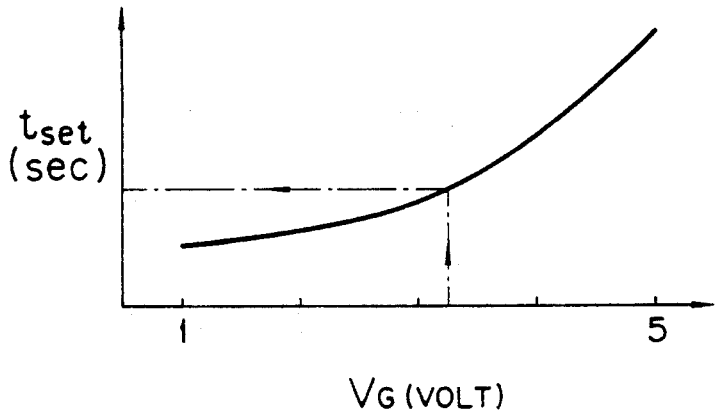

The preset period of time t set since the engine rotation number becomes 500 rpm firstly after the engine starting at step 134 in FIG. 10 may be a value depending upon the average battery voltage Bav until the engine starting is completed (the engine rotation number becomes 500 rpm firstly after engine starting) since the key switch is turned on as shown in FIG. 16, may be a value depending upon the battery voltage B on completion of the engine starting as shown in FIG. 17, or may be a value depending upon the output value VG of the meter on completion of the engine starting. Alternatively, the preset period of time t set may be determined by using a two dimensional map having the battery voltage B and the output value VG of the meter 53 on completion of the engine starting in coordinates. Alternatively, the preset period of time t set may be determined by using a two dimensional map having the average battery voltage Bav and the output value VG of the meter 53 as coordinates from the turning on of the key switch to the completion of the engine starting.

The time of the completion of the engine starting may be the time when driving of a starter motor is stopped (the time t4 in FIG. 11.)

Although the output value VG of the meter 53 is compared with a given value (reference value Vref) at step 132 in FIG. 10 in the foregoing embodiment, the intake air quantity measured by the meter 53 (the value which is converted to the air quantity after processing by ECU) may be compared with a given value.

We claim:

1. An apparatus for controlling an internal combustion engine which admits an intake air from an intake air passage comprising;

a hot wire air flow meter provided in said air intake passage for detecting the quantity of said intake air;

means for calculating a controlled quantity of the internal combustion engine based upon the quantity of said intake air detected by the hot wire air flow meter;

means for smoothing the controlled quantities calculated by said controlled quantity calculating means;

control means for controlling the internal combustion engine based upon the controlled quantities which are smoothed by said smoothing means;

a key switch for starting the operation of said hot wire air flow meter;

means for controlling the starting of the internal combustion engine based upon the controlled quantities on starting in lieu of the controlled quantities which are smoothed by said smoothing means until the starting of said internal combustion engine is completed; and means for substantially starting the smoothing processing of the controlled quantities by said smoothing means at the time (E) from the time (C) at which said hot wire air flow meter is activated after turning on of said key switch before the time (D) at which starting of said internal combustion engine is completed.

2. An apparatus according to claim 1 in which said smoothing starting means includes means for prohibiting the smoothing processing by said smoothing means until a predetermined period of time has lapsed since the key switch is turned on.

3. A apparatus according to claim 2 in which said smoothing processing prohibiting means includes means for making a smoothing constant zero for the predetermined period of time.

4. An apparatus according to claim 1 in which said smoothing starting means includes means for starting the smoothing processing by assuming as an initial value a value which is just lately detected by said hot wire air flow meter at the starting time of the smoothing processing.

5. An apparatus according to claim 2 and further including a battery for supplying said hot wire air flow meter with power by the turning on of said key switch; and means for presetting said predetermined period of time depending upon the voltage of said battery on starting of the internal combustion engine.

6. An apparatus according to claim 1 in which said controlled quantity is a fuel injection quantity fed to the internal combustion engine and in which said means for controlling on starting includes means for presetting the injection quantity on starting as said controlled quantity on starting based upon the temperature of the internal combustion engine.

7. An apparatus according to claim 1 in which said means for controlling on starting includes means for determining that the starting is completed when the rotational speed of the internal combustion engine becomes a predetermined rotation speed on starting or more.

8. An apparatus according to claim 7 and further including means for determining whether or not the output of said hot wire air flow meter reaches a value corresponding to said activation of said meter and in which said controlled quantity is a fuel injection quantity of the internal combustion engine and in which said means for controlling on starting includes means for preparing as said controlled quantity on starting the injection quantity on starting based upon the temperature of the internal combustion engine if the output of said hot wire air flow meter reaches a value corresponding to said activation when the starting by said starting completing means is completed, and means for preparing said injection quantity on starting based upon the temperature of the internal combustion engine for the predetermined period of time if the output of said hot wire air flow meter does not reach a value corresponding to said activation when the starting by said starting completing means is completed.

9. An apparatus for controlling the fuel quantity to an internal combustion engine comprising;

a hot wire air flow meter disposed in an intake passage of the internal combustion engine for controlling a current to keep the temperature of a hot wire heated with the current at a constant value and for outputting the current value as a voltage value;

starting completion detecting means for detecting the completion of starting of the internal combustion engine;

rotation number detecting means for detecting the rotation number of the internal combustion engine;

first control means for supplying the internal combustion engine with a fuel quantity corresponding to at least the temperature of an engine coolant for starting the internal combustion engine before the completion of the internal engine starting detected by said starting completion detecting means after starting of power supply to the hot wire of the hot wire air flow meter started by turning on of a key switch;

second control means for supplying the internal combustion engine with a fuel quantity corresponding to the intake air quantity detected by the hot wire air flow meter and the engine rotation number detected by said rotation number detecting means when the output value of said hot wire air flow meter or a value corresponding thereto is less than a predetermined value on completion of the engine starting detected by said starting completion detecting means; and third control means for supplying said internal combustion engine with a fuel quantity corresponding to at least the engine coolant temperature or a predetermined fuel quantity for optimal fuel injection for a predetermined period of time after the time when the output value of said hot wire air flow meter or a value corresponding thereto is larger than a predetermined value on completion of the engine starting detected by said starting completion detecting means and for supplying said internal combustion engine with a fuel quantity corresponding to the intake air quantity detected by the hot wire air flow meter and the engine rotation number detected by said rotation number detecting means after the lapse of the predetermined period of time.

* * * * *